United States Patent [19]

Bragaglia

[11] Patent Number: 4,984,491

[45] Date of Patent: Jan. 15, 1991

[54] ROTARY CUTTING HEAD, PARTICULARLY FOR TOBACCO CUTTING MACHINES

[75] Inventor: Giorgio Bragaglia, Bologna, Italy

[73] Assignee: Comas S.p.A., Treviso, Italy

[21] Appl. No.: 255,164

[22] PCT Filed: Feb. 19, 1987

[86] PCT No.: PCT/EP87/00075

§ 371 Date: Aug. 15, 1988

§ 102(e) Date: Aug. 15, 1988

[87] PCT Pub. No.: WO87/04905

PCT Pub. Date: Aug. 27, 1987

[51] Int. Cl.[5] ..... A24B 7/12; B26D 1/86

[52] U.S. Cl. ..... 83/338; 83/628; 83/642; 83/674; 83/700

[58] Field of Search ..... 83/338, 174, 646, 628, 83/639, 700, 674, 642

[56] References Cited

U.S. PATENT DOCUMENTS

| | | | |
|---|---|---|---|
| 2,835,299 | 5/1958 | Pollmann | 83/174 |
| 3,769,867 | 11/1973 | Schilling | 83/338 |
| 4,364,402 | 12/1982 | Komossa et al. | 83/700 X |
| 4,537,104 | 8/1985 | Dealto et al. | 83/348 |

FOREIGN PATENT DOCUMENTS

| | | | |
|---|---|---|---|
| 551181 | 3/1977 | U.S.S.R. | 83/338 |
| 1040742 | 9/1966 | United Kingdom | 83/338 |

*Primary Examiner*—Douglas D. Watts
*Assistant Examiner*—Eugenia A. Jones
*Attorney, Agent, or Firm*—Sughrue, Mion, Zinn, Macpeak & Seas

[57] ABSTRACT

A cutting device for cutting a block of tobacco includes a rotatable support and guide structure mounted for rotation about an axis disposed at an angle to the direction of advance of the block of tobacco. A plurality of movable blade carrier elements are mounted on the support guide structure with each element carrying a cutting blade adapted to intersect and penetrate the block of tobacco. Each carrier element is axially movable independently of the other carrier elements and is pressed against a stationary cam member by a thrust member. Upon rotation of the support and guide structure, each blade carrier reciprocates in response due to engagement with the cam member.

4 Claims, 5 Drawing Sheets

ROTARY CUTTING HEAD, PARTICULARLY FOR TOBACCO CUTTING MACHINES

BACKGROUND OF THE INVENTION

The present invention relates to a rotary cutting head, particularly for tobacco cutting machines.

It is known that, in order to make high quality cigarettes, it is necessary for the tobacco to be cut cleanly into strips of uniform width in an optimum manner, with a minimum percentage of tobacco powder.

SUMMARY OF THE INVENTION

The object of the present invention is to provide a rotary cutting head which is particularly suitable for tobacco cutting machines and enables a block of tobacco leaving a supply device to be cut in an optimum manner, so that the tobacco is effectively cut and not broken into bits, and has very uniform dimensions and a minimum percentage of powder.

This object is acheved according to the invention by means of a cutting head comprising a rotatable shaft supported by a fixed structure at an angle to the direction of advance of a block of tobacco, at least one movable element rotatable by the shaft and carrying at least one cutter blade which is movable axially relative to the shaft for cutting the block of tobacco.

BRIEF DESCRIPTION OF THE DRAWINGS

Further characteristics and advantages of the cutting head according to the invention will become apparent from the detailed description which follows with reference to the appended drawings, provided purely by way of non-limiting example, in which.

DETAILED DESCRIPTION OF THE INVENTION

Figure 1:
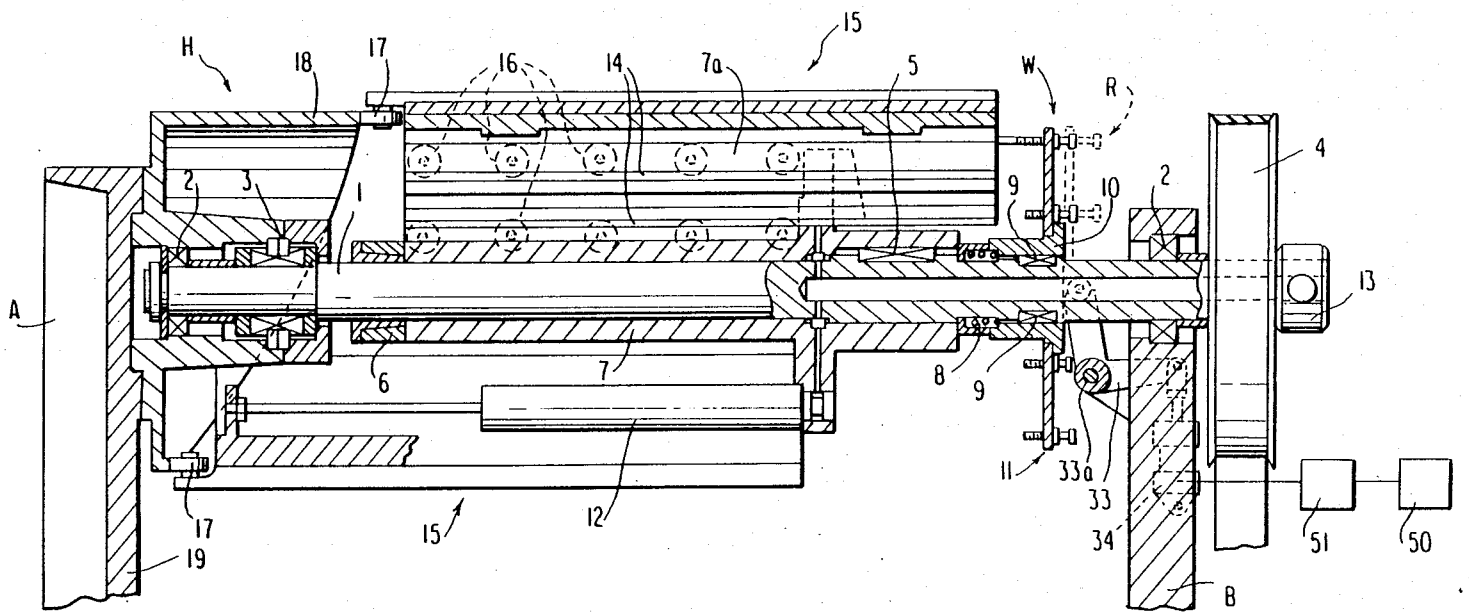
FIG. 1 is a partially-sectioned, cut-away front view of part of a tobacco cutting machine incorporating a cutting head according to the present invention.

FIG. 1 shows a tobacco cutting machine comprising a fixed support structure including two vertical pillars A and B located side by side. A cutting head according to the present invention, generally indicated H, is rotatably mounted between the pillars. The head includes a shaft 1 rotatably supported at its ends by the pillars A and B by means of rolling bearings 2, and held axially by a double thrust bearing 3. One end of the shaft 1 passes through the pillar B and a pulley 4 is keyed onto it.

A hub 7 disposed around the shaft 1 is clamped axially by means of a sealed keying device 6 of known type and is rendered rigid with the shaft by means of keys 8. A hub 10 is mounted on the shaft between the end of the hub 7 facing the pillar B and the pillar, and has a circumferential disc appendage 11. The hub 10 is slidable axially along the shaft 1 but is rendered torsionally rigid with the latter by means of keys 9.

The end of the shaft 1 which passes through the pillar B is hollow so as to allow the pneumatic supply of a plurality of pusher cylinders 12 arranged parallel to the shaft 1 and each having its respective body fixed to a radial appendage of the hub 7. A rotary pneumatic distributor of known type is mounted on the hollow end of the shaft 1.

In the embodiment shown by way of example in the drawings, the cutting head has six cutting blades 20 each carried by a respective movable element 15. For simplicity, FIG. 2 illustrates only one movable element 15, although all the other blades are indicated.

Figure 2:
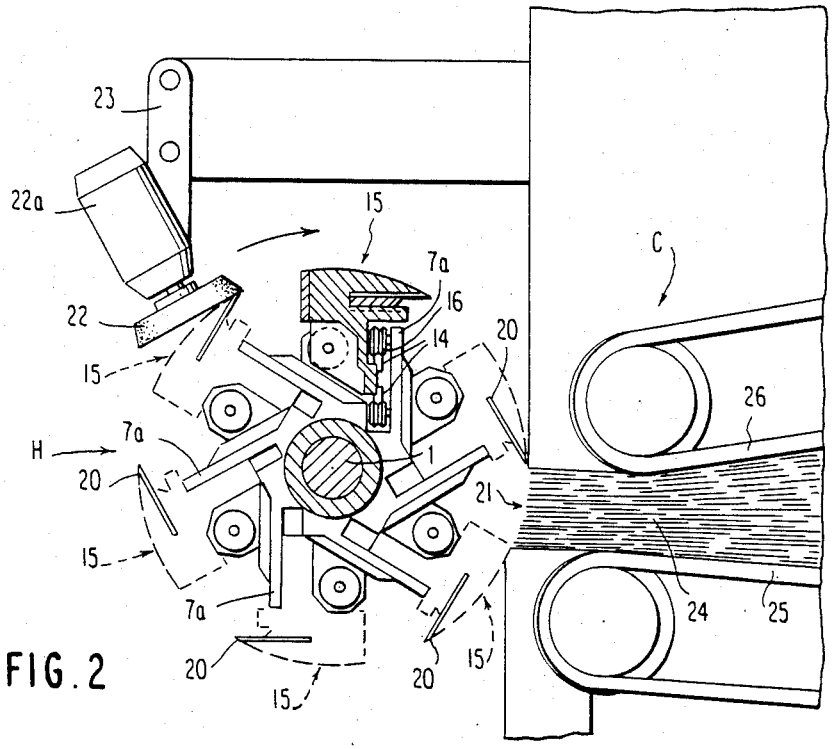
FIG. 2 is a simplified side elevational view of the machine shown in FIG. 1, with the associated device for supplying a block of tobacco by extrusion.
Figure 4:
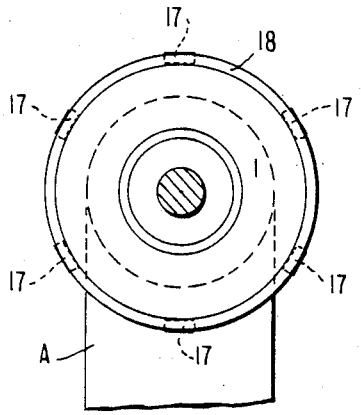
FIG. 4 is a front view of a cam included in the machine of FIG. 1.
Figure 8:
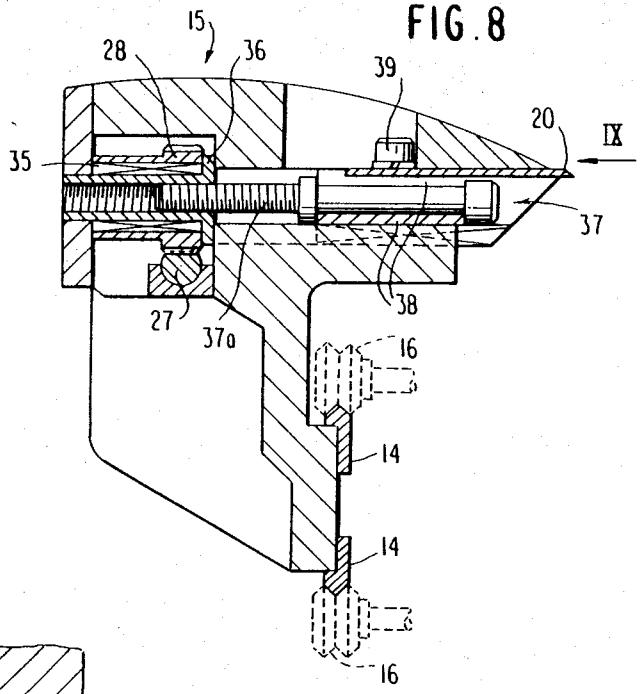
FIGS. 7 and 8 are two cross-sectional views, on an enlarged scale, of a movable blade-holder device forming part of the cutting head according to the invention, in first and second conditions of use respectively.
Figure 7:
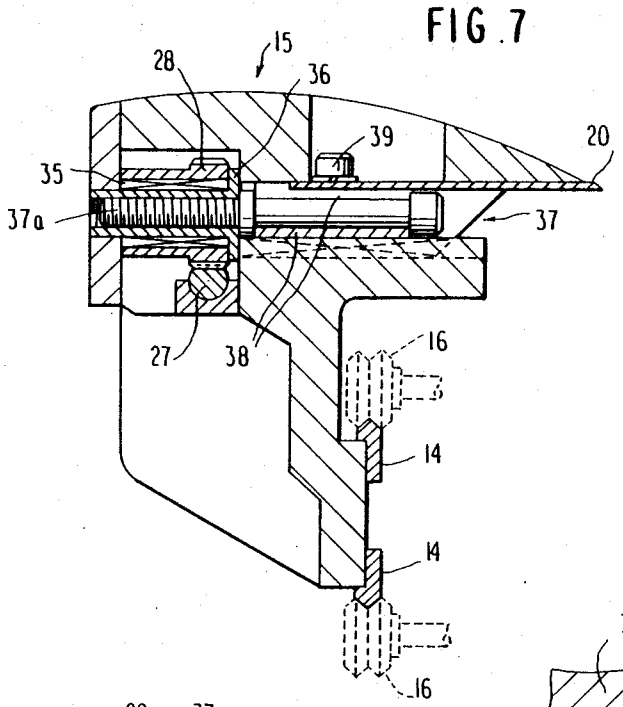

Each movable element includes a shaped blade-holder body 15 which, as seen particularly from FIGS. 2, 7 and 8, is provided on one side with a pair of parallel guides 14 having respective V-shaped guide profiles which engage in the corresponding V-shaped grooves in a plurality of pairs of opposing rollers 16 (FIGS. 1 and 2) carried by a corresponding longitudinal flange *7a* lying almost tangential to the hub 7 (FIG. 2). The movable elements 15 are thus rigid for rotation with the shaft 1 and the hub 7 but can move axially relative to them. As seen particularly from FIGS. 1, 3 and 5, each movable element 15 carries, at its end facing the pillar A, a roller 17 which engages the drive profile of a bell-shaped cam member 18 fixed to the top of the column and having a central hub-shaped portion in which the shaft 1 is supported for rotation. Each cylinder 12 is associated with a corresponding movable element 15 and, as shown particularly in the lower part of FIG. 1, the rod of each of these cylinders is connected to one end of the associated movable element. When the cutting head H is rotated by means of a belt coupled with the pulley 4, the pressure supplied to the cylinders 12 makes them urge the movable elements 15 into the position in which the respective feeler roller 17 engages the shaped drive profile of the cam 18. For each revolution effected by the head H, the movable blade-holder elements 15 execute a reciprocating axial translational movement. The cam 18 is particularly shaped so that, under the action of the pneumatic cylinders 12, each movable blade-holder element 15 effects a sharp axial movement (from right to left for an observer of FIGS. 1 and 3) when the blade carried thereby passes in front of the aperture or outlet opening 21 of an extrusion supply device C (FIG. 2) and intersects and penetrates the block of tobacco 24. By way of example, FIG. 2 illustrates a known type of supply device for extruding a wad of tobacco, including a lower fixed track 25 and an upper movable track 26.

Each blade 20 of the cutting head thus penetrates the mass or block of tobacco with a true and proper slicing action, achieving an optimum clean cut through the tobacco with a minimum percentage of powder.

As stated above, the axial translational movement of the movable elements 15 is controlled by the drive profile of the cam 18 and is determined by the force of the pneumatic cylinders 12, each of which acts on a respective movable element. These cylinders, conveniently of the single-acting type, are kept constantly under pressure from a pressure supply by means of the rotary pneumatic distributor 13 and through the hollow shaft 1.

The blades 20 may be sharpened periodically, for example, by means of a rotary grinding wheel 22 operated by a motor 22*a* carried by an axially movable support structure 23.

The cutting device according to the invention is not provided with any heating system for cleaning the cutting blades 20. In effect, in the device according to the invention, a certain quantity of heat is developed as a result of the action of the pneumatic cylinders 12 and it also has an automatic self-cleaning effect on the blades as a result of their axial translational movement.

Figure 5:
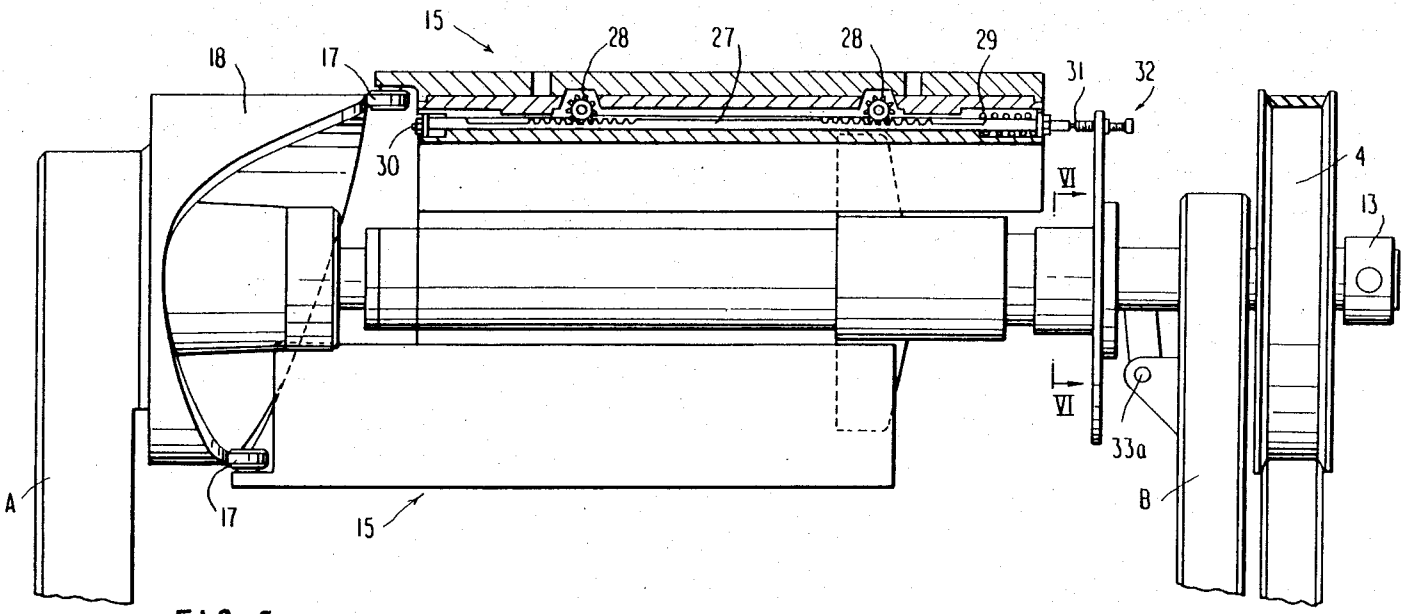
FIG. 5 is a simplified, partically-sectioned front view similar to the view of FIG. 1.
Figure 6:
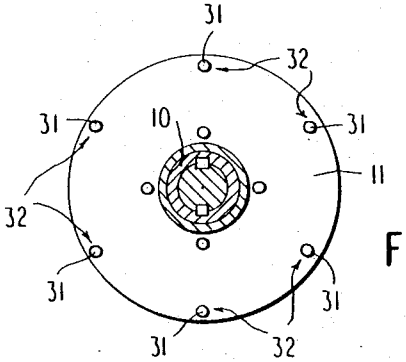
FIG. 6 is a front view of a tappet-holder disc forming part of the machine according to the invention.

Of particular importance in a rotary cutting device for tobacco is the micrometric regulation of the position of the cutting blades for recovery of wear. In the device of the invention, the wear of the cutting edge of the blade is considerably reduced compared with prior art guillotine cutting devices. However, it is in any case necessary periodically to effect a micrometric advance of the blades to recover the wear due to cutting and to enable the sharping device 22 to dress the cutting edge. With reference to FIGS. 5, 7 and 8, there is mounted in each movable element 15 a rack rod 27 which extends longitudinally along the entire element and is movable axially relative thereto under the action of a spring 29 (FIG. 5). This spring, which reacts against an annular end shoulder of the rack 27, keeps the latter projecting permanently from the element 15 (towards the right for an observer of FIG. 5). The projecting end of each rack 27 faces and is aligned with a respective tappet 31 carried by the disc portion 11 of the hub 10. As stated above, the disc 11 is slidable axially along the shaft 1 and, in the embodiment illustrated, carries six tappets 31 arranged parallel to the axis of the shaft 1, at positions axially adjustable by screws 32.

Figure 3:
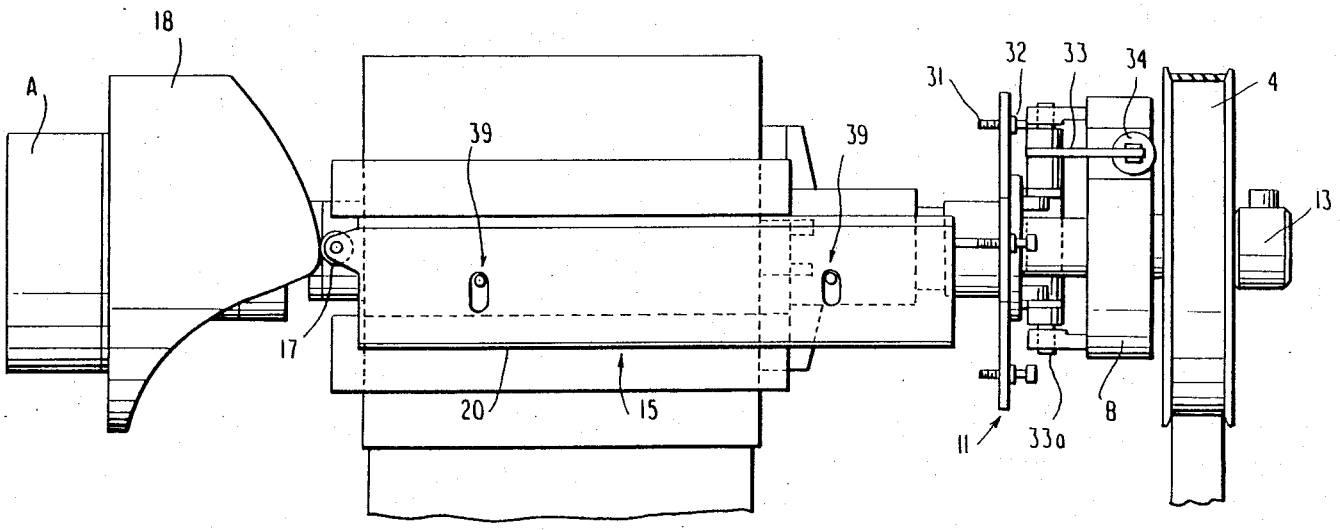
FIG. 3 is a simplified view of the machine shown in FIG. 1 from above.

As shown in FIGS. 5, 7 and 8, two internally-threaded bushes 36 are provided adjacent the rack 27 in each movable element 15 and have their axes arranged perpendicular to the length of the rack 27 and the blade 20. These bushes are coupled by free wheel devices 35 to spockets 28 which mesh with the rack 27. The threaded portions 37*a* of rods 37 are engaged in the internal threadings of the bushes 36 and extend through a member 38 to which the cutting blade 20 is fixed by means of screws 39. The heads of the screws 39 extend into slots in the upper covering member of the movable element 15. These slots are arranged, as shown in FIG. 3, to allow the cutting blade 20 to move in the direction of the axes of the rods 37.

The free wheel devices 35, which are of known type, enable the threaded bushes 36 to rotate solely in the sense corresponding to unscrewing of these bushes from the threaded parts of the rods 37, and hence enable the cutting blades 20 to move towards the right for an observer of FIGS. 7 and 8.

The position of the disc 11 relative to the shaft 1 can be controlled by means of a lever 33 pivoted at 33*a* (FIG. 1) and having one end articulated to the rod of a pneumatic cylinder 34 controlled by a programmed electronic unit 50 through solenoid valves 51. By means of the cylinder 34 and the lever 33, the disc 11 can be moved between a withdrawn or rest position, illustrated R in FIG. 1, in which the tappets 31 do not interfere with the racks 27 of the movable elements and a plurality of advanced positions, such as that indicated W in FIG. 1, in which the tappets 31 can make the racks 27 re-enter the movable elements 15 when these are urged towards the pulley 4 by the can 18. When the rack 27 of a movable element 15 is made to re-enter (FIG. 5), it causes a rotation of the sprockets 28 and, by means of the free wheel devices 35, a corresponding rotation of the threaded bushes 36 and unscrewing of the bolts 37 from these bushes. The associated cutting blade 20 is then advanced. The amount of advancement of the cutting blade 20 depends on the amount of axial movement of the rack 27 caused by the tappet-holder disc 10.

FIG. 7 shows a movable element with a new cutting blade 20, while FIG. 8 shows a movable element in which the blade 20 has a smaller width as a result of considerable wear and is held in an advanced position by the wear take-up device described above.

Figure 10:
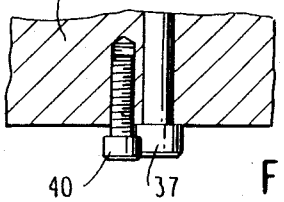
FIG. 10 is a sectional view taken on the line X—X of FIG. 9
Figure 9:
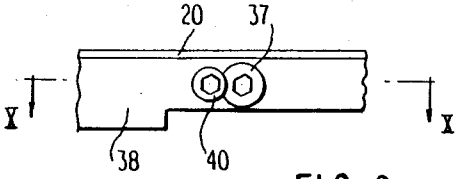
FIG. 9 shows a detail on the arrow IX FIG. 8.

When a rack 27 is made to re-enter its respective movable element by the tappets of the disc 11, the threaded bushes 36 act on the threaded portions 37*a* of the bolts 37 in the manner of nuts. These bolts move axially, their rotation being prevented by screws 40 (FIGS. 9 and 10) which are screwed into the blade-holder member 38 and the heads of which extend into lateral recesses formed in the end heads of the bolts 37.

When it is necessary to return the blade-holder members 38 to the withdrawn position illustrated in FIG. 7, it suffices to loosen the clamping screws 40 to free the heads of the bolts 37, and then to rotate the latter in the sense in which they screw into the threaded bushes 36.

In order to replace the cutting blades 20, it suffices to remove the screws 39.

Naturally, the principle of the invention remaining the same, the forms of embodiment and details of realisation may be varied widely with respect to that described and illustrated purely by way of non-limiting example, without thereby departing from the scope of the present invention.

I claim:

1. A cutting device, particularly for cutting a block of tobacco leaving a supply device, comprising:

a support and guide structure supported so as to be rotatable about an axis lying at an angle to the direction of advance of the block of tobacco;

a plurality of movable blade-carrier elements mounted on said support and guide structure with each element carrying a cutting blade adapted to intersect and penetrate the block of tobacco leaving the supply device; each blade-carrier element and associated blade being movable axially relative to the said support and guide structure independently of each other;

drive means for rotating the guide and support structure, and control means for sequentially effecting an axial reciprocating translational movement of each blade-carrier element in synchronism with a revolution of the support and guide structure during the cutting of the block of tobacco;

the control means including a stationary cam member having a shaped drive profile; each blade-carrier element having a respective feeler member cooperating with said drive profile, and thrust means carried by said structure for urging each feeler against said drive profile of the cam member.

2. A device according to claim 1, wherein the thrust means include a pneumatic cylinder.

3. A device according to claim 1, wherein said plurality of movable blade-carrier elements are equiangularly spaced about the support and guide structure.

4. A device according to claim 1 further comprising regulating means for causing a controlled advance of the cutting blade of each movable blade-carrier element in a direction perpendicular to the cutting edge of the blade to compensate for wear of the blade.

* * * * *